US005806125A

United States Patent [19]

Shockley et al.

[11] Patent Number: 5,806,125

[45] Date of Patent: Sep. 15, 1998

[54] TRANSPARENCY CLEANING DEVICE

[76] Inventors: Paul E. Shockley, 411 W. Taylor St.; Clarence L. Millikan, 302 S. McLeansboro, both of Benton, Ill. 62812

[21] Appl. No.: 541,314

[22] Filed: Oct. 10, 1995

[51] Int. Cl.[6] ..... B08B 11/20

[52] U.S. Cl. ..... 15/102; 15/100; 134/122 P

[58] Field of Search ..... 15/102, 100, 88.1, 15/77, 4, 245, 104.92; 134/64, 122 R, 122 P, 9, 15

[56] References Cited

U.S. PATENT DOCUMENTS

| | | | |
|---|---|---|---|
| 1,156,994 | 10/1915 | Greene | 15/100 |
| 1,352,712 | 9/1920 | Werner | 15/100 |
| 1,669,394 | 5/1928 | Ellis et al. | 134/9 |
| 1,933,084 | 10/1933 | Allison | 15/100 |
| 2,282,628 | 5/1942 | Whann et al. | 15/102 |
| 2,289,753 | 7/1942 | Capstaff | 15/100 |
| 2,739,336 | 3/1956 | Weeks | 15/100 |
| 2,796,618 | 6/1957 | Amdt | 15/100 |
| 3,158,886 | 12/1964 | Grimes | 15/100 |
| 3,737,941 | 6/1973 | Miller et al. | 15/100 |
| 3,792,503 | 2/1974 | Brock | 15/4 |
| 3,938,213 | 2/1976 | DiFede | 15/77 |
| 4,222,656 | 9/1980 | Harrell et al. | 15/102 |
| 4,363,154 | 12/1982 | Lee | 15/102 |
| 4,942,421 | 7/1990 | Gumbinner | 15/102 |

FOREIGN PATENT DOCUMENTS

| | | | |
|---|---|---|---|
| 435704 | 9/1935 | United Kingdom | 15/100 |

*Primary Examiner*—Gary K. Graham
*Attorney, Agent, or Firm*—Haverstock, Garrett & Roberts

[57] ABSTRACT

A transparency cleaning device includes a pair of oppositely disposed wiping blades formed of a windshield wiper type soft rubber material, each of the wiping blades being biased to engage a surface of the transparency which passes therebetween, each of the wiping blades is attached to a corresponding member, said members being movable relative to each other so that the transparency can be easily directed between the wiping blades; as the transparency passes between the wiping blades the cleaning fluid is removed from the surfaces thereof without damage to the transparency, the wiping blades are also oriented during the cleaning operation so that the cleaning fluid removed from the transparency flows off of one end of the wiping blades toward the bottom of the cleaning device. Several embodiments are described including open and closed frame constructions having a rotatable crank operably connected to a transparency receiving member as well as a smaller, more portable version configured to be placed over a sink as the transparency is manually pulled through the device.

7 Claims, 3 Drawing Sheets

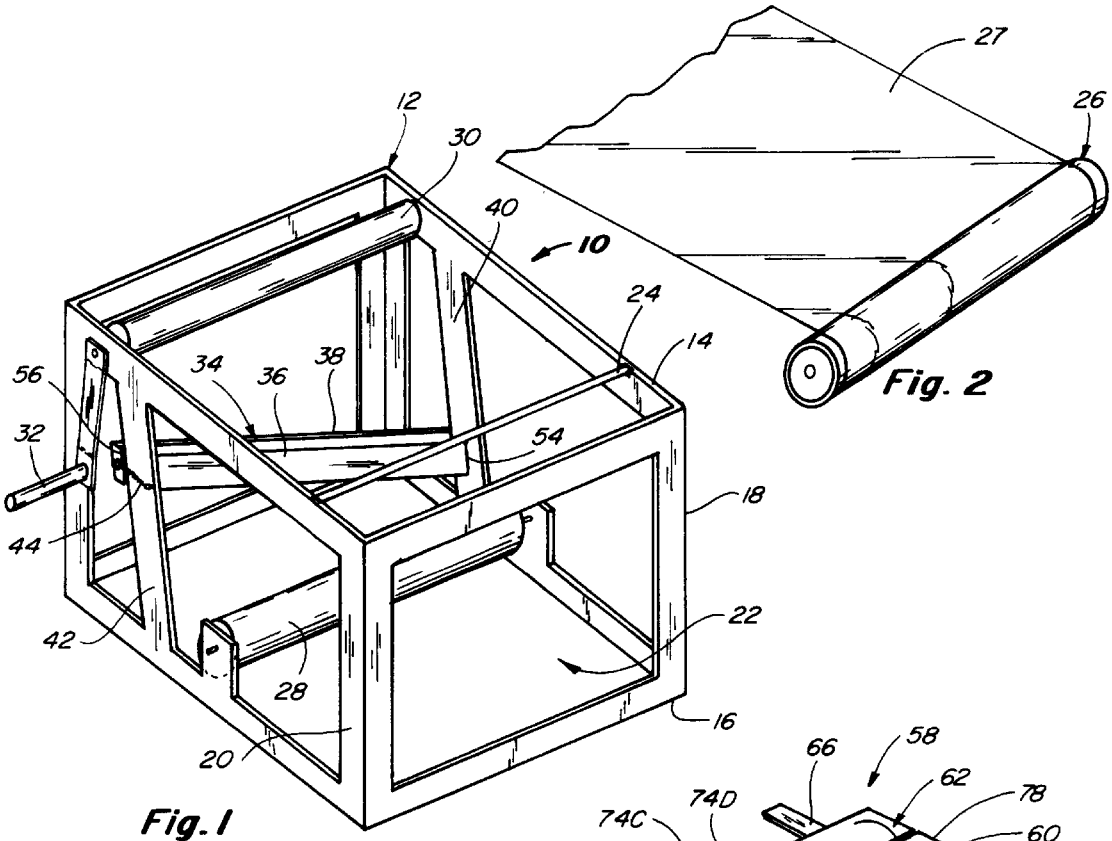
Fig. 1
Fig. 2
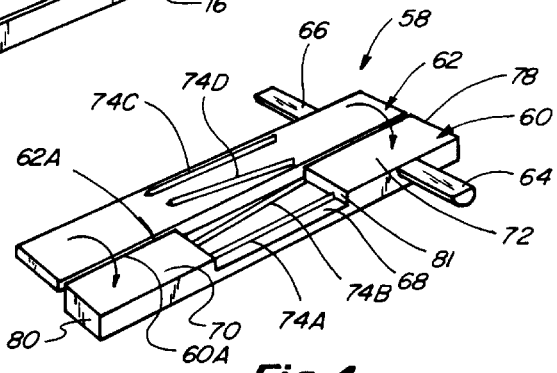
Fig. 4
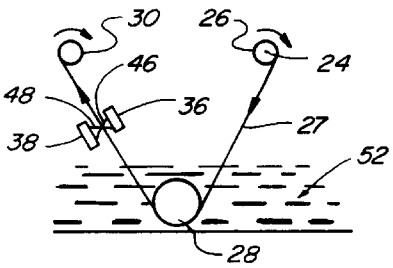
Fig. 3
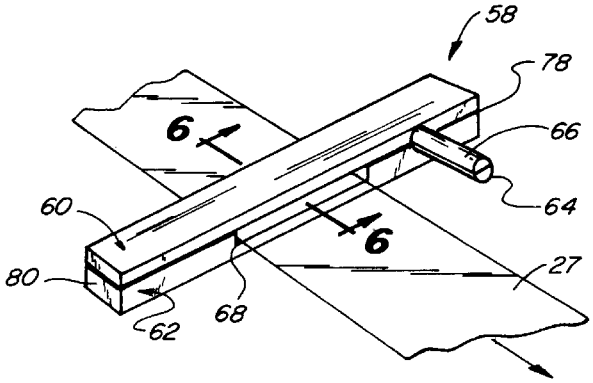
Fig. 5
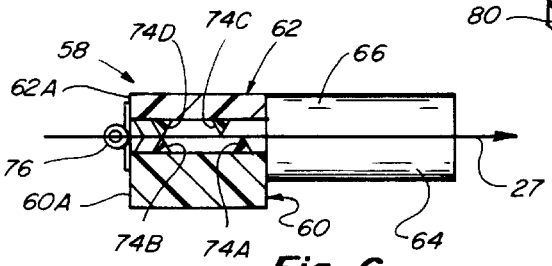
Fig. 6

TRANSPARENCY CLEANING DEVICE

FIELD OF THE INVENTION

This invention relates generally to cleaning devices and more particularly, to a device for cleaning transparencies utilized on overhead projectors.

BACKGROUND OF THE INVENTION

A typical overhead projector includes means for holding a transparency such that a portion of the transparency is positioned above a light source. The transparency is typically in the form of a transparent plastic film and is usually wound upon a cylindrical member. Writings and other markings located on the portion of the transparency located above the light source are projected through an imaging device onto a screen or wall allowing such overhead projectors to be used for making presentations or for teaching purposes. The instructor or other person making a presentation generally writes or draws on the portion of the transparency positioned above the light source. When the portion becomes filled with writing the transparency is advanced so that a clean portion of the transparency is exposed for further writing. When the entire transparency becomes filled with writing it must be cleaned so that it can be used again.

Known methods of cleaning transparencies include simple hand washing which is typically done either while the transparency is still located on the overhead projector or after the transparency has been removed from the overhead projector. Cleaning the transparency while it remains on the projector involves a repetitive sequence of cleaning a portion of the transparency with a rag or sponge, partially advancing the transparency, and then cleaning another portion of the transparency. This cleaning method is time consuming and can result in damage to the transparency, such damage reducing the useful life of the transparency. Further, cleaning the transparency on the overhead projector also creates the possibility of damaging the overhead projector with the water or other cleaning fluid which is used.

Cleaning the transparency after it has been removed from the overhead projector involves immersing the transparency in water or other cleaning fluid and then using rags to wipe and dry both surfaces of the transparency. This cleaning method is also time consuming and increases the risk of damaging the transparency. Thus, cleaning transparencies in a school environment where the overhead projector is heavily relied upon is an unwelcome and time consuming burden.

Other known devices for cleaning overhead projector transparencies are unnecessarily complex and large, making them excessively costly and difficult to move from location to location.

Accordingly, it is desirable and advantageous to provide a device for cleaning transparencies which reduces the cleaning time required and also reduces the risk of damaging the transparency. It also is desirable and advantageous to provide a device for cleaning transparencies which is small, portable, and easy to use.

An object of the present invention is to provide a device for cleaning overhead projector transparencies without requiring the use of rags or sponges, thus greatly reducing the cleaning time required.

Another object of the present invention is to provide a transparency cleaning device which effectively reduces the probability of damaging the transparency during cleaning.

Another object of the present invention is to provide a transparency cleaning device including first and second wiping blades biased to engage opposite surfaces of a transparency passing therebetween.

Yet another object of the present invention is to provide a transparency cleaning device which can be made to be small and portable.

SUMMARY OF THE INVENTION

These and other objects of the invention are attained by a device which, in one embodiment, includes an open frame configured and sized for placement in a tub or sink which contains the water or other cleaning fluid. The device includes a member for holding the cylindrical member upon which the transparency is wound. The loose end of the transparency passes under a rotatable guide means located near the bottom of the device so that during a cleaning operation the transparency is submerged in the cleaning fluid as it passes under the guide means. Further, the guide means can include brush or cloth material on its outer surface to aid in cleaning the transparency.

After passing under the guide means the transparency passes between a pair of oppositely disposed wiping blades made from windshield wiper or squeegee type soft rubber material. The blades are configured to allow the transparency to pass between them and they are biased toward each other by a spring or other biasing means so that the blades exert sufficient force to remove all of the cleaning fluid from the transparency. Importantly, the blades are also angled with respect to the frame such that one side of the blade pair is lower than the opposite side of the blade pair, allowing water or other fluid wiped from the transparency to flow toward the lower side and off the blades back into the sink or tub.

After passing between the wiping blades the transparency is attached to a receiving roll which is operable for rotation by turning a crank attached thereto. Thus, during a cleaning operation, the entire transparency is wound from the transparency holding member, under the guide means into the cleaning fluid, through the wiping blades, and on to the receiving roll. The biasing of the wiping blades also exerts sufficient force on the transparency such that the transparency is wound tightly onto the receiving roll so that once the cleaning operation is completed the receiving roll can be removed and the transparency is ready for use on an overhead projector.

The device allows transparencies to be cleaned quickly and the risk of tearing or otherwise damaging the transparency is reduced because there is less handling of the transparency by the user. Thus, the device reduces the time associated with cleaning transparencies and reduces the long term cost of use of such transparencies because transparencies cleaned with the device normally have a longer useful life. Further, the device, which can be made of plastic or other water resistant material, is of open frame construction and is therefore lightweight, facilitating its transportability.

A second embodiment of the invention is a smaller, more portable version which includes two members which are hinged to one another. When closed, one face of the first hinged member lies adjacent a corresponding face of the second hinged member. The first hinged member includes a recessed portion for the attachment of wiping blades. In this regard, at least one wiping blade is located on each of the hinged members such that when the hinged members are closed, the wiping blades contact opposing surfaces of the transparency which passes therebetween. Accordingly, as the transparency is pulled between the hinged members the wiping blades act to remove the cleaning fluid from both surfaces of the transparency.

Importantly, each hinged member also preferably includes a handle portion extending therefrom so that the device may be easily controlled and to facilitate pressing the two hinged members toward each other. The hinged members may also include automatic biasing means, such as spring loaded hinges, for pressing the two hinged members toward each other. This device may be sized to extend across a sink allowing it to be braced against the sink sides during use. Thus, the present invention facilitates quick, efficient cleaning of transparencies.

In a further embodiment of the present invention, a pair of hinged members are removably combined with an open frame and a removable tub. Thus, the hinged members can be used in combination with the transparency holding member and receiving roll of the open frame unit or the hinged members can be removed and used as a separate unit if desired.

BRIEF DESCRIPTION OF THE DRAWINGS

FIG. 1 is a perspective view of an open frame transparency cleaning device.

FIG. 2 is a perspective view of a typical transparency wound upon a cylindrical member.

FIG. 3 is a partial side view of the open frame unit of FIG. 1 having a transparency running therethrough.

FIG. 4 is a perspective view of a hinged member transparency cleaning device in an open position.

FIG. 5 is a partial side view of the hinged member device of FIG. 4 in a closed position.

FIG. 6 is a cross-sectional view along line 6—6 of FIG. 5.

DETAILED DESCRIPTION OF THE DRAWINGS

Figure 7:
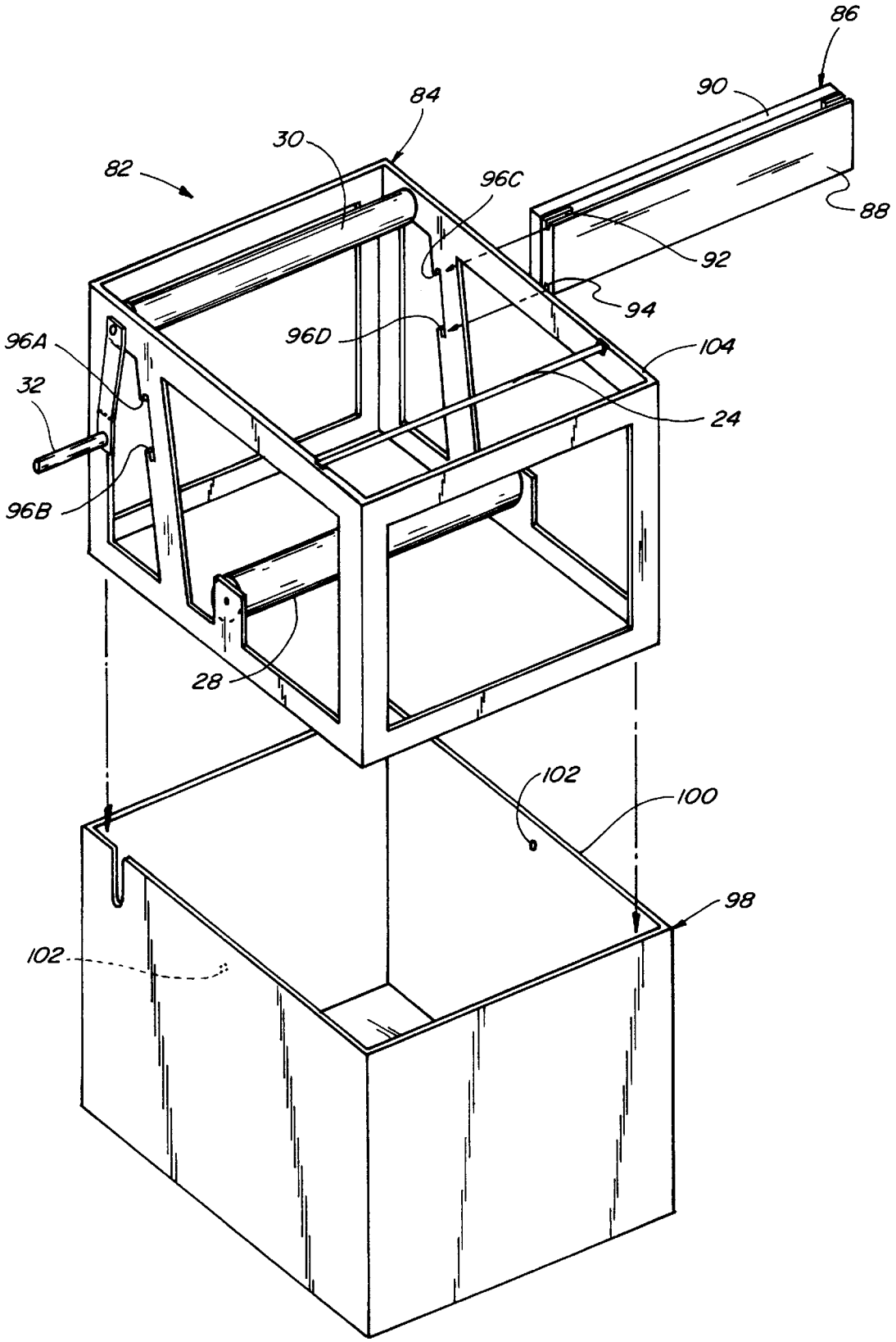
FIG. 7 is an exploded view of an open frame transparency cleaning device including a removable wiping assembly and a removable tub.

Illustrated in FIG. 1 is a transparency cleaning device 10 including a frame 12 which is constructed of molded plastic or some other water resistant material. The frame 12, including top 14, bottom 16, and side portions 18 and 20, is sized and configured to fit within a sink or tub which holds water or other cleaning fluid. The frame 12 is also of open construction, minimizing the weight of the device 10 and allowing water contained within the sink or tub to flow freely within the interior portion 22 of the frame 12. A transparency holding member 24 extends between the first side portion 18 and the second side portion 20 of the frame 12. The member 24 is removably attached and configured such that a cylindrical member 26, upon which a transparency 27 is wound as shown in FIG. 2, is capable of rotation when placed thereon. Further, a rotatable guide means 28 and a removable receiving roll 30 which is operable for rotation when a crank 32 is rotated, both extend between the first side portion 18 and the second side portion 20.

Intermediate the guide means 28 and the receiving roll 30, are wiping means 34 which extend between the first side portion 18 and the second side portion 20. The wiping means 34 include first and second members 36 and 38 extending between first side portion 18 and second side portion 20. The first member 36 is fixedly attached to portions 40 and 42 of frame 12 while second member 38 is attached to portions 40 and 42 by biasing means such as spring 44. The second member 38 can also be attached to first member 36 by similar biasing means not shown. Importantly, a pair of wiping blades 46 and 48, as shown in FIG. 3, formed of a windshield wiper or squeegee type soft rubber material are attached to corresponding members 36 and 38. The wiping blades 46 and 48 and members 36 and 38 are configured to allow the transparency 27, shown in FIGS. 2 and 3, to pass therebetween. The spring 44 assures that each wiping blade 46 and 48 engages one surface of the transparency 27.

As illustrated in the partial side view of FIG. 3, the cylindrical member 26 is placed on the member 24 and the transparency 27 is then directed under the guide means 28 which assures that the transparency 27 is submerged in the cleaning fluid 52. After passing under the guide means 28 the transparency 27 is directed between the wiping blades 46 and 48 and onto the receiving roll 30. When the receiving roll 30 is rotated by turning the crank 32 shown in FIG. 1, the transparency 27 is drawn off of the cylindrical member 26, under the guide means 28, between the wiping blades 46 and 48 and onto the receiving roll 30. It is understood that an additional crank could be attached to member 24 for drawing the transparency 27 back through the device 10 if additional cleaning is necessary. Importantly, the wiping blades 46 and 48 engage opposite surfaces of the transparency 27 with sufficient force to remove the cleaning fluid 52 therefrom. Further, as illustrated in FIG. 1, the members 36 and 38 are configured such that a first end 54 is lower than a second end 56, allowing cleaning fluid 52 removed from the transparency 27 to flow downward off of the wiping blades 46 and 48, preventing undesirable build up of cleaning fluid 52 on the wiping blades 46 and 48. If the build up of cleaning fluid 52 is not prevented, streaking of the transparency 27 may occur.

With respect to the spring 44, sufficient biasing is provided so that the wiping blades 46 and 48 which engage the transparency 27 cause a resistive force which assures that the transparency 27 is wrapped tightly onto the receiving roll 30 so that once the cleaning operation is completed the transparency is ready for use on an overhead projector.

Thus, cleaning device 10 provides a quick and reliable means for cleaning the transparency 27 located on the cylindrical member 26. The device 10 is lightweight, portable and configured to be utilized in a sink or tub which holds the cleaning fluid. Importantly, the device 10 reduces the time required to clean transparencies and also reduces the risk of damage to the transparency 27 during the cleaning operation.

Illustrated in FIG. 4 is a transparency cleaning device 58, shown in an open position, which includes first and second members 60 and 62 which are hingedly attached to each other. First and second members 60 and 62 include corresponding handle portions 64 and 66 extending therefrom and aligned such that when the device 58 is closed as shown in FIG. 5, handle portions 64 and 66 meet so that the two hinged members 60 and 62 can be held together with such force as desired by the user. Handle portions 64 and 66 also allow for greater stability and control of the device 58 during a cleaning operation.

As best shown in FIG. 4, the first member 60 includes a recessed portion 68 located between two elevated portions 70 and 72. One or more blades such as blades 74A, 74B, 74C and 74D are provided on each of the members 60 and 62 with the blades 74A and 74B located in the recessed portion 68 of the first member 60. When the device is being used the blades 74B and 74D, which are angled with respect to bottom portions 60A and 62A respectively, are held in such a position that cleaning fluid will run off the blades 74B and 74D at one end thereof This is to prevent the fluid from accumulating on the transparency 27 which may cause a wet spot or smear to occur. As illustrated in FIG. 5 during a wiping operation transparency 27 is passed between the members 60 and 62 and between the wiping blades positioned on the respective, members. One of the advantages of the structure shown in FIGS. 4 and 5 is the device does not take up much space and this construction is especially useful for cleaning relatively short length of a transparency 27.

FIG. 6 is a cross-sectional view of FIG. 5 taken along line 6—6. The blades 74A and 74B on the member 60 are positioned to engage one surface of the transparency 27 while the blades 74C and 74D on the member 62 simultaneously engage the opposite surface of the transparency 27. By holding the members 60 and 62 closed as shown in FIGS. 5 and 6 using the handle portions 64 and 66, the cleaning fluid and any dirt on the transparency 27 will be removed as the transparency 27 is pulled through and between the blades. It is contemplated that the device 58 can have more or fewer blades on each of the members 60 and 62 and it is also contemplated that a different number of wiping blades can be used on one member than is used on the other member. The members 60 and 62 are connected to each other by means of one or more hinges such as hinge 76. The hinge enables the members to be opened and closed and the hinge also is a handy way of connecting the members 60 and 62 that enables the operator to exert as much pressure as is necessary to hold the handles 64 and 66 together. It is also contemplated that the hinge 76 may be of a spring-loaded type such that the device 58 is biased toward the closed position at all times.

In a typical transparency cleaning operation, the device 58 is placed over a sink such that opposite ends 78 and 80, shown in FIGS. 5 and 6, extend over the sides of the sink. The transparency 27 is submerged in the cleaning fluid which is contained in the sink and then pulled through the device 58 while the device is held closed by the handle portions 64 and 66. The blades 74A, 74B, 74C, and 74D engage opposite sides of the transparency 27 as it is pulled through the device 58 and the cleaning fluid is thereby removed from the transparency 27. Thus, the device 58 provides a small, easily transportable means for cleaning transparencies, the device 58 being much more efficient than cleaning transparencies with a rag or sponge.

Although the device 58 is illustrated with first member 60 including a recessed portion 68, it is understood that the device could be constructed of two members, neither of which include a recessed portion. The members of such a device would be attached such that when in a closed condition the members would be somewhat spaced from each other due to the blades positioned therebetween. Accordingly, an edge guide means in the form of an edge rail attached to one of the members and along which one edge of the transparency runs for preventing any portion of the transparency from running off of the ends of the blades could be provided. Similar guide means could be provided in all embodiments of the invention disclosed herein and would be helpful in preventing the transparency from being torn or damaged during cleaning. In the device 58 shown, one edge 81 of the recessed portion 68 acts as an edge guide means.

FIG. 7 is an exploded view of a transparency cleaning device 82 which includes an open frame 84 in combination with a removable wiping assembly 86 having a pair of hinged members 88 and 90 similar to the members 60 and 62 illustrated in FIGS. 4–6. The hinged member 88 includes slots 92 and 94 configured to matingly engage tabs 96A, 96B, 96C, and 96D located on the frame 84. The removable wiping assembly 86 is configured such that the width thereof matches the width of frame 84, however, it is understood that the width of the wiping assembly 86 could be larger than the width of frame 84 in which case a portion of removable wiping assembly 86 would extend outward from the frame 84. Further, handle portions could also be included on removable wiping assembly 86.

Figure 8:
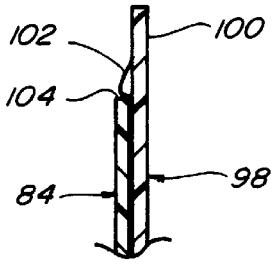
FIG. 8 is a partial cross-sectional view of the frame inserted within the tub of FIG. 7.

Cleaning device 82 also includes a removable tub 98 configured to receive the frame 84 and to retain the cleaning fluid used for a transparency cleaning operation. A top portion 100 of the tub 98 includes one or more inwardly extending retention tabs 102. When the frame 84 is fitted within the tub 98 the retention tabs 102 engage the top 104 of the frame 84 such that the frame 84 is securely held within the tub 98, as best shown in the partial cross-sectional view of FIG. 8. The tabs 102 can be pressed outward away from the frame 84 so that the frame 84 can be removed from the tub 98.

Figure 9:
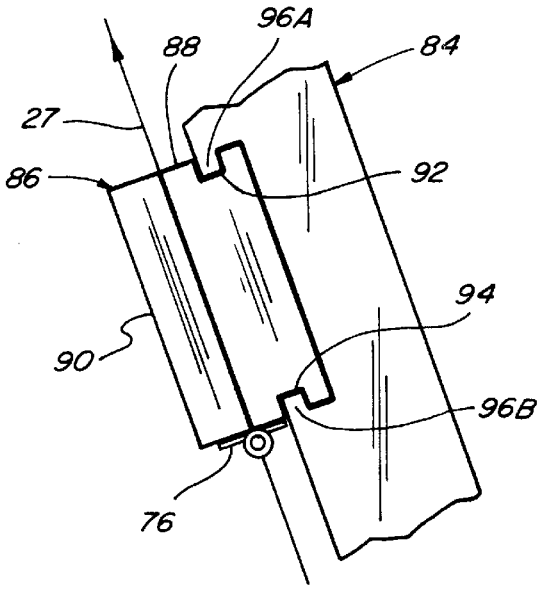
FIG. 9 is a partial side elevational view of the removable wiping assembly engaged with the frame of FIG. 7.

FIG. 9 is a partial side elevational view of the removable wiping assembly 86 inserted on frame 84. The slots 92 and 94 snugly engage the tabs 96A and 96B such that the removable wiping member 84 is securely held in place during a cleaning operation. Hinge 76 allows the members 88 and 90 to be opened and closed such that the transparency 27 can be passed therebetween and is spring loaded so that the members 88 and 90 and corresponding wiping blades, such as those shown in FIGS. 4 and 6, are biased to engage the surfaces of the transparency 27.

The operation of the device 82 is similar to that of the device 10 illustrated in FIGS. 1 and 3. Importantly, the device 82 includes removable wiping assembly 86 which can be used separately in a transparency cleaning operation similar to that described above with respect to device 58 of FIGS. 4–6. Thus, the device 82 can be used as a stand alone unit including the tub 98, the frame 84, and the removable assembly 86. Further, the device can be used without the tub 98 by placing the frame 84 in a separate tub or sink. Still further, removable wiping assembly 86 can be used independently in a transparency cleaning operation.

Figure 10:
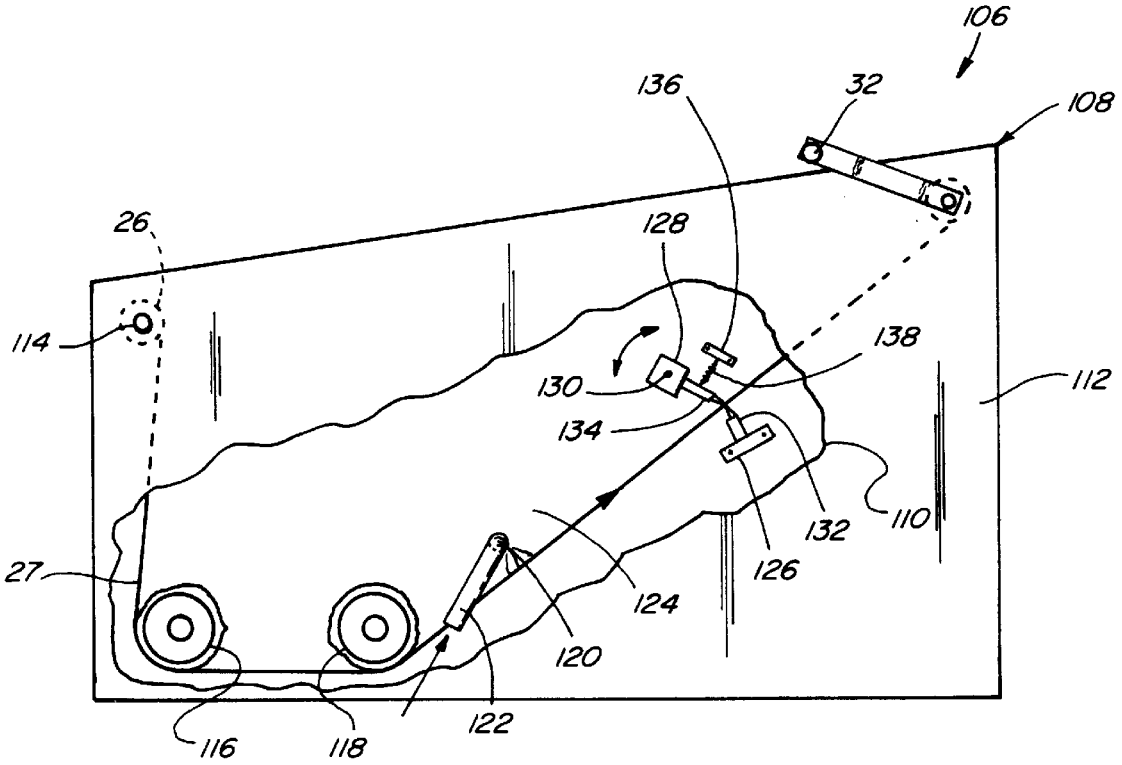
FIG. 10 is a side view of a closed frame transparency cleaning device with a portion of the frame cut away.

With respect to tub 98 illustrated in FIG. 7, the tub 98 could also be fixedly attached to the frame 84. In such case it may be desirable to provide a drain opening in the bottom portion of the tub 98 for ease of removing the cleaning fluid. Such a transparency cleaning device 106 is illustrated in the side view of FIG. 10 which shows an enclosed frame 108 with a portion 110 of a side portion 112 cut away. A cylindrical member 26 is placed on transparency holder 114 and the transparency 27 is directed below the two guide means 116 and 118. A tubular member 120 extends across the frame 108 and includes a plurality of perforations therein and a non-perforated portion 122 of the tubular member 120 extends through the frame to the exterior thereof Portion 122 is configured for connection to a hose or other fluid carrying device and fluid passing into tubular member 120 flows through the perforations into the interior portion 124 of the frame 108 and onto the transparency 27 in the form of a continuous spray which also aids in cleaning the surface of the transparency 27.

A first member 126 is fixedly attached to the frame and a second member 128 is pivotally attached to the frame at point 130. Each member 126 and 128 includes a corresponding wiping blade 132 and 134. A lateral member 136 also extends across the frame 108 and is fixedly attached to the side portions thereof. A spring 138 which extends from the lateral member 136 to the second member 128 urges member 128 toward member 126 such that the wiping blade 134 is urged toward the wiping blade 132 and the wiping blades 134 and 132 engage opposite surfaces of the transparency 27 passing therebetween. Crank 32 is also provided for mechanically drawing the transparency 27 through the device as described above with respect to FIG. 1.

From the preceding description of the illustrated embodiments, it is evident that the objects of the invention are attained. In particular, a transparency cleaning device which includes wiping blades which are biased to engage opposite surfaces of a transparency are provided. Further, portable cleaning devices are provided which effectively reduce the cleaning time required and also effectively reduce the risk of damage to the transparency. The illustrated embodiments thereby reduce the long term cost associated with cleaning transparencies. Although the invention has been described and illustrated in detail, it is to be clearly understood that the same is intended by way of illustration and example only and is not to be taken by way of limitation.

For example, the shape the frames 12 and 84, illustrated in FIGS. 1 and 7 respectively, could be modified while still remaining within the scope of the invention. Further, the location and number of wiping blades utilized in each of the embodiments could also be varied. In addition, the tub 98 illustrated in FIG. 7 could be permanently attached to the frame 84. Accordingly, the spirit and scope of the invention are to be limited only by the terms of the appended claims.

What is claimed is:

1. A device for removing images and liquid from a transparency, said device comprising a frame, first and second support members, and first and second wiping blades, said frame including top bottom, and first and second side portions, said bottom portion defining a plane, said frame being sized and shaped to fit within a sink or tub, said frame comprised of interconnected elongated bars to form an open construction so as to be adapted to allow fluid to flow into and out of said frame freely when said frame is positioned within a sink or tub, said first and second support members extending from side to side of said frame and coupled thereto, said first wiping blade being attached to said first support member and said second wiping blade being attached to said second support member, said first and second support members positioned relative to each other such that said first and second wiping blades face each other, said first and second support members movable relative to each other such that said first and second wiping blades are yieldable relative to each other to allow a transparency to be passed therebetween, said first and second wiping blades adapted to engage opposite surfaces of the transparency, said first and second wiping blades dragging across and removing liquid from the surfaces of the transparency as the transparency moves relative to said first and second wiping blades, said first and second support members inclined from side to side of said frame with respect to said plane such that said first and second wiping blades are also inclined with respect to said plane so that during a cleaning operation the liquid removed from the surfaces of the transparency runs toward a corresponding end of each wiping blade and off of each wiping blade.

2. The device according to claim 1 further comprising at least one hinge attached to said first and second support members and an edge guide positioned between said support members when said device is in a closed condition, said edge guide assuring that said first and second wiping blades engage the surfaces of the transparency as the transparency moves relative to the blades.

3. A device for cleaning an overhead projector transparency with a cleaning fluid, the transparency wound on a cylindrical member, said device comprising, a frame including top, bottom, and first and second side portions, said bottom portion defining a plane, said frame sized and shaped for positioning in a sink or tub and being comprised of interconnected elongated bars to form an open construction so as to allow fluid to flow into and out of said frame when said frame is positioned therein;

means for rotatably holding the cylindrical member upon which a transparency is wound;

means for guiding the transparency towards the bottom portion of said frame;

means for wiping the cleaning fluid from the transparency, said means including at least one wiping blade positioned on a first support member and at least one wiping blade positioned on a second support member, said first and second support members extending between and coupled to said side portions of said frame and adjacent each other such that the at least one wiping blade on said first support member faces the at least one wiping blade on said second support member, said first and second support members movable relative to each other and biased toward each other; and means for drawing the transparency off of the cylindrical member, said means comprising a rotatable member for receiving said transparency as it is drawn off of the cylindrical member.

4. The cleaning device of claim 3 wherein said first and second support members are angled from side to side of said frame with respect to said plane such that said first and second wiping blades are also angled with respect to said plane to allow cleaning fluid wiped from the transparency to flow toward one side portion of said frame and off of said wiping blades.

5. The cleaning device of claim 3 wherein said means for drawing the transparency off of the cylindrical member further comprises a crank operably attached to said rotatable member, said rotatable member rotating in response to manual rotation of said crank.

6. A device for cleaning an overhead projector transparency with a cleaning fluid, the transparency wound on a cylindrical member, said device comprising, a frame including top, bottom, and first and second side portions, said bottom portion defining a plane;

means for rotatably holding the cylindrical member upon which a transparency is wound;

means for guiding the transparency towards the bottom portion of said frame;

means for wiping the cleaning fluid from the transparency, said means including first and second wiping blades attached to corresponding first and second members, said first and second members positioned adjacent each other at a distance to allow the transparency to pass therebetween, biasing means connected to at least one of said first and second members and urging said first and second members toward each other so that each wiping blade is adapted to engage an opposite surface of the transparency, said first member being attached to said frame at a first location on said first side portion and at a second location on said second side portion, a height of said first location on said frame with respect to said plane being lower than a height of said second location on said frame with respect to said plane, said second member running substantially parallel to said first member such that both said first and second wiping blades are angled with respect to said plane so that cleaning fluid wiped from the transparency flows toward one side portion of said frame and off of said wiping blades; and means for drawing the transparency off of the cylindrical member, said means comprising a rotatable member for receiving said transparency as it is drawn off of the cylindrical member.

7. The cleaning device of claim 6 further comprising at least one spring attached between said second member and said frame.

* * * * *